US005518645A

United States Patent [19]

Beaujean et al.

[11] Patent Number: 5,518,645

[45] Date of Patent: May 21, 1996

[54] PROCESS FOR THE PRODUCTION OF PASTE-FORM DETERGENTS

[75] Inventors: Hans-Josef Beaujean, Dormagen; Jens Bode, Monheim; Norbert Schaefer, Duesseldorf, all of Germany

[73] Assignee: Henkel Kommanditgesellschaft auf Aktien, Duesseldorf, Germany

[21] Appl. No.: 338,565

[22] Filed: Dec. 7, 1994

[30] Foreign Application Priority Data

May 19, 1992 [DE] Germany ..... 42 16 453.2

[51] Int. Cl.[6] ..... C11D 11/00; C11D 1/12; C11D 1/755

[52] U.S. Cl. ..... 252/108; 252/174.14; 252/367; 252/368; 252/549; 252/554; 252/DIG. 1

[58] Field of Search ..... 252/108, 367, 252/368, DIG. 1, 174.14, 549, 554

[56] References Cited

U.S. PATENT DOCUMENTS

| | | | |
|---|---|---|---|
| 4,755,318 | 7/1988 | Davies et al. | 252/109 |
| 4,929,380 | 5/1990 | Schulz et al. | 252/121 |
| 5,244,593 | 9/1993 | Roselle et al. | 252/99 |

FOREIGN PATENT DOCUMENTS

| | | | |
|---|---|---|---|
| 0253151 | 1/1988 | European Pat. Off. | C11D 1/72 |
| 0373483 | 6/1990 | European Pat. Off. | C11D 1/83 |
| 2237285 | 5/1991 | United Kingdom | C11D 9/02 |
| 9013623 | 11/1990 | WIPO | C11D 1/83 |
| 9114766 | 10/1991 | WIPO | C11D 3/39 |

*Primary Examiner*—Sharon Gibson
*Assistant Examiner*—Patricia L. Hailey
*Attorney, Agent, or Firm*—Ernest G. Szoke; Wayne C. Jaeschke; Real J. Grandmaison

[57] ABSTRACT

A process for producing a paste-form, substantially water-free detergent by heating a mixture of nonionic and anionic surfactants to a predetermined temperature, adding soap in particulate form to the heated mixture, then cooling the mixture, and adding builder components and a bleaching agent to the mixture.

14 Claims, No Drawings

PROCESS FOR THE PRODUCTION OF PASTE-FORM DETERGENTS

BACKGROUND OF THE INVENTION

1. Field of the Invention

This invention relates to a process for the production of paste-form, water-free or substantially water-free detergents and cleaning compositions which are stable to sedimentation despite the presence of insoluble constituents.

2. Discussion of Related Art

Paste-form detergents and cleaning compositions, hereinafter referred to as detergents, have advantages insofar as they are easy to handle and, in terms of equipment, are relatively easy to produce, another advantage being that their ingredients may be selected from a relatively broad range so that their composition may largely be adapted to meet specific washing requirements. Paste-form detergents differ in this regard from liquid detergents which, unless suitable measures are taken, show unwanted sedimentation in cases where they contain insoluble constituents. In addition, where active oxygen compounds are part of the formulation, liquid detergents also generally undergo an applicationally unacceptable degradation of active oxygen. This is promoted by free water and by polyhydric alcohols (preferably with adjacent OH groups or even with residual monomer constituents in polyols). Sedimentation-stable paste-form detergents show more favorable behavior in this regard.

Accordingly, the problem addressed by the present invention was to provide a process for the simple production of paste-form detergents which would be stable to sedimentation despite the presence of insoluble constituents. A key feature of the paste-form detergents to be produced is the absence or substantial absence of water.

DESCRIPTION OF THE INVENTION

Accordingly, the present invention relates to a process for the production of paste-form, water-free or substantially water-free detergents containing nonionic and anionic surfactants, soap, builders and bleaches, characterized in that the soap is incorporated in fine-particle or dispersed form in the heated mixture of nonionic and anionic surfactants and the remaining constituents of the detergent are incorporated after cooling of the mixture. In the context of the present invention, "substantially free from water" means that at most 3% by weight of water is added to the detergents during their production. In addition, water may be present in small quantities as a secondary constituent of formulation ingredients. Accordingly, "water-free" means that no water is added to the detergents to be produced by the process according to the invention, although water may be present in small quantities as a secondary constituent of formulation ingredients. Suitable anionic surfactants are, for example, synthetic surfactants of the sulfonate, sulfate or succinate type.

Suitable surfactants of the sulfonate type are alkyl benzenesulfonates ($C_{9-15}$ alkyl), mixtures of alkane and hydroxyalkanesulfonates and also the disulfonates obtained, for example, from monoolefins with a terminal or internal double bond by sulfonation with gaseous sulfur trioxide and subsequent alkaline or acidic hydrolysis of the sulfonation products. Other suitable surfactants of the sulfonate type are alkanesulfonates obtainable from alkanes by sulfochlorination or sulfoxidation and subsequent hydrolysis or neutralization or by addition of bisulfite onto olefins. Other useful surfactants of the sulfonate type are the esters of α-sulfofatty acids, for example the α-sulfonic acids of hydrogenated methyl or ethyl esters of coconut oil, palm kernel oil or tallow fatty acid.

Suitable surfactants of the sulfate type are the sulfuric acid monoesters of primary alcohols (for example of coconut oil fatty alcohols, tallow fatty alcohols or oleyl alcohols) and those of secondary alcohols. The alkoxylation products of the above-mentioned surfactants of the sulfate type are also suitable, as are sulfated fatty acid alkanolamides, fatty acid monoglycerides or reaction products of 1 to 4 moles of ethylene oxide with primary or secondary fatty alcohols. Other suitable anionic surfactants are the fatty acid esters and amides of hydroxylcarboxylic or aminocarboxylic acids, such as for example fatty acid sarcosides, glycolates, lactates, taurides or isethionates.

Anionic surfactants of the succinate type are, for example, alkylsuccinates containing long-chain alkyl groups or alkylsulfosuccinates.

The anionic surfactants may be present in the form of their sodium, potassium and ammonium salts and as soluble salts of organic bases, such as mono-, di- or triethanolamine.

Nonionic surfactants are, for example, adducts of 4 to 40 moles and preferably 4 to 20 moles of ethylene oxide with 1 mole of fatty alcohol, alkylphenol, fatty acid, fatty amine, fatty acid amide or alkanesulfonamide. Particularly important nonionic surfactants are the adducts of 5 to 16 moles of ethylene oxide with coconut oil or tallow fatty alcohol, with oleyl alcohol or with secondary alcohols containing 8 to 18 and preferably 12 to 18 carbon atoms and with mono- or dialkylphenols containing 6 to 14 carbon atoms in the alkyl groups. In addition to these water-soluble nonionic surfactants, however, water-insoluble or substantially water-insoluble polyglycol ethers containing 1 to 4 ethylene glycol ether groups in the molecule are also of interest, particularly when they are used together with water-soluble nonionic or anionic surfactants.

Other suitable nonionic surfactants are the water-soluble addition products—containing 20 to 250 ethylene glycol ether groups and 10 to 100 propylene glycol ether groups—with ethylene oxide or propylene oxide, alkylenediamine polypropylene glycol and alkyl polypropylene glycols with 1 to 10 carbon atoms in the alkyl chain, in which the polypropylene glycol chain acts as a hydrophobic component. Nonionic surfactants of the amine oxide or sulfoxide type may also be used.

Examples of a few particularly interesting adducts of alkylene oxide with long-chain alcohols are, for example, mixtures of oleyl alcohol and cetyl alcohol with an iodine value of 50 to 55 onto which around 7 moles of ethylene oxide have been added per mole of alcohol, $C_{12-18}$ fatty alcohol onto which around 5 moles of ethylene oxide have been added and $C_{13-15}$ oxoalcohol onto which 5 to 8 moles of ethylene oxide have been added. Other interesting nonionic surfactants of this type are adducts of ethylene oxide and propylene oxide with fatty alcohols.

Another class of suitable nonionic surfactants are alkyl glucosides containing a $C_{8-18}$ alkyl group, preferably an alkyl group consisting essentially of $C_{10}$ to $C_{16}$ which is derived from decyl, lauryl, myristyl, cetyl and stearyl alcohol and from technical fractions containing preferably saturated alcohols. It is particularly suitable to use alkyl glucosides in which 50 to 70% by weight of the alkyl component contains $C_{12}$ alkyl groups and 18 to 30% by weight $C_{14}$ alkyl groups. The degree of oligomerization of suitable alkyl glucosides is between 1 and 10 and preferably between 1 and 6.

Although soap is also an anionic surfactant, it is regarded as a separate constituent in the context of the present invention. Suitable soaps are the salts of saturated and unsaturated fatty acids containing 12 to 18 carbon atoms which may also be present in the form of their mixtures.

Suitable builders are, in particular, zeolite A, polycarboxylates, citrate, phosphonates, carbonates, silicates, aminopolycarboxylic acid and polymers of acrylic acid and maleic anhydride.

Suitable bleaches, which release hydrogen peroxide in the wash liquor, are for example sodium perborate tetrahydrate ($NaBO_2.H_2O_2.3H_2O$) and the monohydrate ($NaBO_2.H_2O_2$). However, other borates yielding hydrogen peroxide, for example perborax ($Na_2B_4O_7.H_2O$), may also be used. These compounds may be completely or partly replaced by other active oxygen carriers, more particularly by peroxyhydrates, such as peroxycarbonates ($Na_2CO_3.1.5\ H_2O_2$), peroxypyrophosphates, citrate perhydrates, urea/$H_2O_2$ or melamine/$H_2O_2$ compounds, and by peracidic salts yielding hydrogen peroxide, such as for example caroates ($KHSO_5$), perbenzoates or peroxyphthalates. It is advisable to incorporate typical water-soluble and/or water-insoluble stabilizers for the peroxy compounds together with the peroxy compounds in quantities of 0.25 to 10% by weight. Suitable insoluble stabilizers are, for example, alkaline earth metal silicates while suitable water-soluble stabilizers are, for example, organic complexing agents.

If the detergents to be produced in accordance with the invention are to be used at low washing temperatures, it is advisable to add activators to them. Activators ensure that hydrogen peroxide is released at relatively low washing temperatures. Suitable activators are known bleach activators such as, for example, tetraacetyl ethylenediamine (TAED) or tetraacetyl glycoluril (TAGU).

In the process according to the invention, the soap is incorporated either in the form of fine particles or in dispersed form. "Fine particles" in the context of the invention are understood to be particles with a particle size of less than 0.4 mm. In this fine-particle form, the soap may be incorporated without the addition of water and without having to use high-performance dispersers. Another method of incorporating the soap is to incorporate the soap in dispersed form in the heated mixture of nonionic and anionic surfactants. The mixture of nonionic and anionic surfactants is preferably heated to 70° to 90° C. and preferably to 80° to 85° C. before incorporation of the soap.

Another embodiment of the process according to the invention is characterized in that the soap is incorporated in the heated mixture of nonionic and anionic surfactants in the form of particles with a particle size of at most 0.4 mm with no addition of water. In many cases, incorporation of the soap is facilitated by the use of high-performance dispersers. Accordingly, another embodiment of the process according to the invention is characterized in that the soap is incorporated in the heated mixture of nonionic and anionic surfactants using a mixing unit operating on the stator/rotor principle. However, the soap may also be dispersed in water before it is incorporated in the surfactant mixture. In this case, water is used in such a quantity that the final detergent contains at most 1% by weight of water.

After cooling of the mixture which now consists of anionic surfactants, nonionic surfactants and soap, the other constituents of the detergent are incorporated. The mixture of nonionic and anionic surfactants and soap is preferably cooled to below 30° C. before the other constituents of the detergent are incorporated.

In one preferred embodiment of the process according to the invention, at least two different nonionic surfactants are used in the mixture of nonionic and anionic surfactants. These nonionic surfactants are preferably fatty alcohol ethoxylates containing 12 to 18 carbon atoms in the fatty alcohol component with different degrees of ethoxylation of 2 to 7 moles of ethylene oxide per mole of fatty alcohol; they are used in quantities of 3 to 60% by weight, based on the final detergent.

The type and quantity of soap used is important for establishing the paste-like consistency of the detergents produced in accordance with the invention. Sodium salts of linear fatty acids containing 12 to 22 carbon atoms are preferably used in quantities of 0.5 to 10% by weight, based on the final detergent, as the soap. In the process according to the invention using the nonionic and anionic surfactants mentioned and also soap, the paste-like consistency of the detergents is established over a period of 24 hours after mixing. Until then, the detergent produced in accordance with the invention is pourable and may readily be transported, pumped and introduced into containers.

Polycarboxylates and/or phosphonates and/or carbonates and/or silicates in quantities of 10 to 50% by weight, based on the final detergent, are preferably used as builders in the process according to the invention. Another preferred builder is water-insoluble zeolite A.

In the production of the detergents in accordance with the invention, sodium perborate and/or sodium percarbonate are preferably used as bleaches, if desired in combination with activators, of which tetraacetyl ethylenediamine or diperoxydodecane dioic anhydride—in addition to tetraacetyl glycoluril—in quantities of 10 to 30% by weight, based on the final detergent, are preferred.

In addition, other detergent ingredients such as, for example, enzymes, foam inhibitors, optical brighteners, soil suspending agents, fragrances and dyes may be incorporated in small quantities in the production of the paste-form detergents in accordance with the invention.

The advantage of the detergents produced in accordance with the invention is that, despite their reliable stability to sedimentation, the detergents are initially liquid and can be readily pumped, transported and introduced into containers in this state, developing their paste-like consistency after about 24 hours so that the handling advantages mentioned at the beginning are guaranteed. In addition, detergents produced in accordance with the invention show a negligible degradation of active oxygen.

EXAMPLES

Example 1

A mixture of nonionic and anionic surfactants having the following composition was prepared at 80° to 85° C.:

| | |
|---|---|
| 33.5% by weight | $C_{12-15}$ oxoalcohol + 2 moles ethylene oxide |
| 16.5% by weight | $C_{12-18}$ fatty alcohol + 7 moles ethylene oxide |
| 6.5% by weight | $C_{13-17}$ alkanesulfonate - sodium salt |
| 6.5% by weight | $C_{12-16}$ alkylsulfate - sodium salt |
| 0.2% by weight | $C_{12-18}$ fatty acid - sodium salt. |

The soap was incorporated in the form of a dispersion in 1 part by weight of water.

After cooling to room temperature, the surfactant mixture thus obtained was mixed with

| | |
|---|---|
| 2.1% by weight | 1-hydroxyethane-1,1-diphosphonic acid, disodium salt |
| 5.5% by weight | copolymer of acrylic acid and maleic anhydride (Sokalan CP 5 ®, a product of BASF, Germany) |
| 10.0% by weight | sodium perborate monohydrate |
| 3.0% by weight | tetraacetyl ethylenediamine |
| 5.5% by weight | zeolite A |
| 8.1% by weight | sodium carbonate |
| Balance to 100% by weight | optical brightener, foam regulator, fragrance, enzyme in small quantities. |

The mixture was liquid and could be pumped, transported and introduced into containers without any problems.

After 24 hours, the mixture had developed a paste-like consistency. It showed excellent stability to sedimentation although the sodium perborate monohydrate had the following particle distribution:

| | |
|---|---|
| >1.0 mm | 0.1% |
| >0.5 mm | 14.7% |
| >0.4 mm | 37.4% |
| >0.2 mm | 90.7% |
| >0.1 mm | 99.9% |

60.7% of the sodium carbonate had a particle size of >0.1 mm.

Example 2

If 1 part by weight of fine-particle soap powder (<0.4 mm) rather than 0.2 part by weight of dispersed soap was added to the surfactant mixture of Example 1, a paste-form detergent with comparable properties was obtained when the soap was incorporated with a high-speed mixer operating on the stator/rotor principle ("Supraton"). Paste-form detergents totally free from water can be produced in this way.

We claim:

1. The process of producing a paste-form, substantially water-free detergent composition comprising heating a mixture of nonionic and anionic surfactants to a temperature of from 70° to 90° C., adding to said mixture with mixing from 0.5 to 10% by weight of a soap in the form of particles having a particle size of up to 0.4 mm, based on the weight of said detergent composition, cooling the mixture of nonionic and anionic surfactants and soap to a temperature below 30° C., and adding to said mixture with mixing from 10 to 50% by weight, based on the weight of said detergent composition, of builder components and from 10 to 30% by weight, based on the weight of said detergent composition, of a bleaching agent, wherein said detergent composition contains at most 1% by weight of water.

2. A process as in claim 1 wherein mixing of said detergent composition is with a stator/rotor mixing unit.

3. A process as in claim 1 wherein said soap, prior to addition to said mixture of nonionic and anionic surfactants, is dispersed in a quantity of water such that said detergent composition contains at most 1% by weight of water.

4. A process as in claim 1 wherein said nonionic surfactants are present in a quantity of from 3 to 60% by weight, based on the weight of said detergent composition.

5. A process as in claim 1 wherein said nonionic surfactants are selected from the group consisting of fatty alcohol ethoxylates containing 12 to 18 carbon atoms in the alcohol component and 2 to 7 moles of ethylene oxide per mole of said alcohol.

6. A process as in claim 1 wherein said soap comprises sodium salts of linear fatty acids containing 12 to 22 carbon atoms.

7. A process as in claim 1 wherein said builder components are selected from the group consisting of zeolite A, polycarboxylates, citrates, phosphonates, carbonates, silicates, aminopolycarboxylic acids, and polymers of acrylic acid and maleic anhydride.

8. A process as in claim 1 wherein said bleaching agent is selected from the group consisting of sodium perborate and sodium percarbonate.

9. A process as in claim 1 wherein an amount of from 10 to 30% by weight of an activator component for said bleaching agent is present in said detergent composition.

10. A process as in claim 9 wherein said activator component is selected from the group consisting of tetraacetyl ethylenediamine and diperoxydodecane dioic anhydride.

11. A process as in claim 1 including adding to said detergent composition an enzyme, foam inhibitor, optical brightener, soil suspending agent, fragrance and dye.

12. A process as in claim 1 wherein said anionic surfactants are selected from the group consisting of sulfonates, sulfates and succinates.

13. A process as in claim 1 wherein said nonionic surfactants are selected from the group consisting of alkyl glucosides and alkoxylated alkylphenols.

14. A process as in claim 1 wherein said nonionic surfactants comprise two different nonionic surfactants.

* * * * *